US009306316B2

(12) United States Patent
Aizawa

(10) Patent No.: US 9,306,316 B2
(45) Date of Patent: Apr. 5, 2016

(54) FERRITE CORE INTEGRATED WATERPROOF CONNECTOR

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventor: Takeshi Aizawa, Yokkaichi (JP)

(73) Assignees: AUTONETWORKS TECHNOLOGIES, LTD. (JP); SUMITOMO WIRINGS SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/453,025

(22) Filed: Aug. 6, 2014

(65) Prior Publication Data

US 2015/0044895 A1 Feb. 12, 2015

(30) Foreign Application Priority Data

Aug. 7, 2013 (JP) ..... 2013-163710

(51) Int. Cl.
*H01R 13/66* (2006.01)
*H01R 13/52* (2006.01)
*H01R 13/6588* (2011.01)
(Continued)

(52) U.S. Cl.
CPC ..... *H01R 13/5202* (2013.01); *H01R 13/6588* (2013.01); *H01R 13/6598* (2013.01); *H01R 13/6599* (2013.01); *H01R 13/5208* (2013.01); *H01R 2201/26* (2013.01)

(58) Field of Classification Search
CPC ..... H01R 13/719; H01R 13/6658; H01R 13/6666; H01R 13/52
USPC ..... 439/587, 589, 274, 275
See application file for complete search history.

(56) References Cited

U.S. PATENT DOCUMENTS 4,079,343 A * 3/1978 Nijman ..... H03H 1/0007 333/183
5,613,868 A * 3/1997 Ohsumi ..... H01R 13/5221 439/275

(Continued)

FOREIGN PATENT DOCUMENTS

JP 2006-012487 1/2006

*Primary Examiner* — Abdullah Riyami
*Assistant Examiner* — Thang Nguyen
(74) *Attorney, Agent, or Firm* — Gerald E. Hespos; Michael J. Porco; Matthew T. Hespos

(57) ABSTRACT

A ferrite core integrated waterproof connector includes wires (WH) each having a terminal fittings (20) mounted thereon and a housing (10) with terminal accommodating chambers (12A, 12B) for accommodating the terminal fittings (20). A plate-like rubber plug (30) covers a rear surface (10B) of the housing (10) and has wire insertion holes (31) arranged to correspond to the terminal accommodating chambers (12A, 12B). Lips (32) are formed on the inner peripheral surfaces of the wire insertion holes (31) for closely contacting the outer peripheral surfaces of coatings of the wires (WH). At least one ferrite core (50) is embedded in the one-piece rubber plug (30) and has at least one hollow portion 52 concentric with at least some of the wire insertion holes (31). The ferrite core (50) is radially outward of base parts of the lips (32) of the one-piece rubber plug (30).

8 Claims, 4 Drawing Sheets

(51) Int. Cl.
*H01R 13/6598* (2011.01)
*H01R 13/6599* (2011.01)

(56) References Cited

U.S. PATENT DOCUMENTS

| | | | | |
|---|---|---|---|---|
| 5,634,807 | A * | 6/1997 | Saito | H01R 13/5208 439/275 |
| 6,494,740 | B1 * | 12/2002 | Murakami | H01R 13/5208 439/275 |
| 6,872,092 | B2 * | 3/2005 | Oka | H01R 13/5208 439/275 |
| 7,963,773 | B2 * | 6/2011 | Palli et al. | 439/38 |
| 8,137,132 | B2 * | 3/2012 | Lu | 439/578 |
| 8,243,470 | B2 * | 8/2012 | Jaze et al. | 361/818 |
| 8,272,876 | B2 * | 9/2012 | Schultz | 439/38 |
| 8,337,244 | B2 * | 12/2012 | Sawamura | H01R 13/5208 439/271 |
| 8,419,448 | B2 * | 4/2013 | Konno | 439/86 |
| 8,439,690 | B2 * | 5/2013 | Takeuchi | H05K 3/341 439/66 |
| 8,485,842 | B2 * | 7/2013 | Oue et al. | 439/501 |
| 8,485,844 | B2 * | 7/2013 | Omae et al. | 439/559 |
| 8,525,631 | B2 * | 9/2013 | Balog | 336/212 |
| 8,526,631 | B2 * | 9/2013 | Nakabayashi | 381/86 |
| 8,529,278 | B2 * | 9/2013 | Shiga | 439/272 |
| 9,028,276 | B2 * | 5/2015 | Wilson | H01R 9/0524 439/578 |
| 2002/0052142 | A1 * | 5/2002 | Ishikawa | H01R 13/5216 439/587 |

* cited by examiner

FERRITE CORE INTEGRATED WATERPROOF CONNECTOR

FIELD OF THE INVENTION

The invention relates to a ferrite core integrated waterproof connector.

DESCRIPTION OF THE RELATED ART

A known method for removing noise superimposed on a terminal fitting includes mounting a ferrite core on an end part of a wire accommodated in a connector housing in a connector, such as a connector used for vehicle interior wiring of an automotive vehicle is widely known. Japanese Unexamined Patent Publication No. 2006-12487 discloses mounting a seal formed of a rubber material mixed with a ferrite material on an end part of a wire a technique for providing a connector with both a noise removing function and a waterproof property.

However, a considerable amount of the ferrite material has to be added to exhibit desired noise removing performance. This has led to a problem that lips of the seal member become highly rigid and reduce sealing ability.

The invention was completed based on the above situation and aims to provide a ferrite core integrated connector having high sealability.

SUMMARY OF THE INVENTION

The invention relates to a ferrite core integrated waterproof connector, comprising at least one wire having a terminal fitting connected thereto. The connector further has a housing with at least one terminal accommodating chamber capable of accommodating the terminal fitting. A resilient plug is mounted on the housing and has at least one wire insertion hole arranged to correspond to the terminal accommodating chamber. One or more lips project on the inner peripheral surface of the resilient plug and closely contact the outer peripheral surface of the wire and enable insertion of the wire in a sealed state. A ferrite core is embedded in the resilient plug and is at an inner side of a base part of the one or more lips in a direction opposite to a projecting direction of the lips in the resilient plug.

The resilient plug is a substantially plate-like one-piece rubber plug to be mounted on the housing and to cover a rear end surface of the housing.

The housing preferably is formed with a plurality of terminal accommodating chambers capable of accommodating a plurality of terminal fittings. The resilient plug is formed with a plurality of wire insertion holes arranged to correspond to the respective terminal accommodating chambers.

The ferrite core preferably includes one or more hollow portions substantially concentric with at least some of the wire insertion holes.

The wire insertion hole preferably is formed with a plurality of the lips along an axial direction of the wire insertion hole.

The ferrite core preferably is arranged at a position near an end part of the resilient plug in the axial direction. According to this configuration, the ferrite core is unlikely to affect the deformation of the seal lips on a side opposite to the side where the ferrite core is located in the axial direction in the one-piece rubber plug. Thus, sealing of the wires can be improved further.

According to the above, noise superimposed on the wires can be removed effectively by the ferrite core embedded in the resilient plug. Further, the ferrite core is provided at the inner side of the base parts of the lips of the resilient plug. Thus, the ferrite core is unlikely to hinder deformation of the lips so that the lips deform into close contact with the wire coatings and good sealing of the wires can be ensured.

These and other features and advantages of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 3:
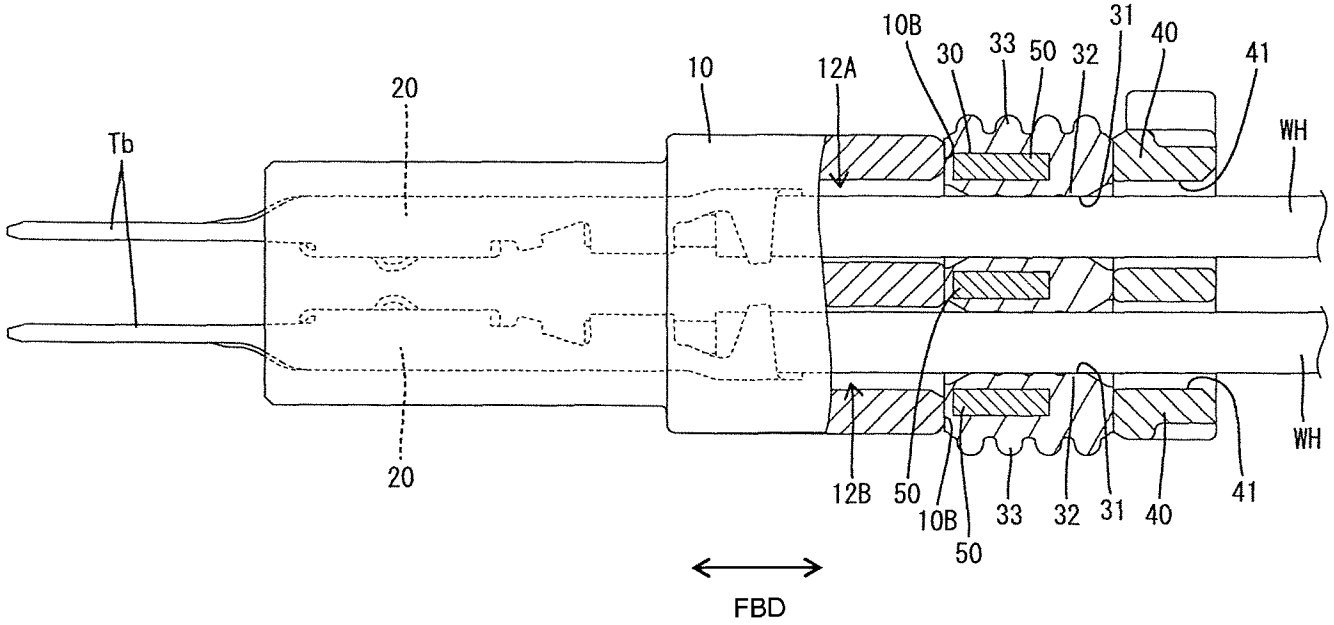
FIG. 3 is a side view in section of the ferrite core integrated waterproof connector according to the first embodiment.

A ferrite core integrated waterproof connector of the invention includes a housing 10, terminal fittings 20 connected to wires WH, a one-piece rubber plug 30 having ferrite cores 50 embedded therein and a holder 40. Note that, in the following description, left and right sides of FIG. 3 are referred to as front and rear ends concerning a front-back direction FBD.

The housing 11 is made of synthetic resin and is in the form of a flat block as a whole. Terminal accommodating chambers 12A, 12B penetrate the housing 11 in the front-back direction FBD and are arranged in a width direction in each of upper and lower rows. The terminal fittings 20 are inserted into the terminal accommodating chambers 12A, 12B from behind. Unillustrated locking lances are cantilevered forward from a lower wall of the terminal accommodating chambers 12A in the lower row and from the upper wall of the terminal accommodating chambers 12B in the upper row. The locking lances are resiliently deformable in a direction intersecting an insertion direction of the terminal fittings 20 into the terminal accommodating chambers 12 and are configured to lock and retain the terminal fitting 20, as shown in FIG. 3, when the terminal fitting 20 is inserted to a proper position in the respective terminal accommodating chamber 12A, 12B.

The one-piece rubber plug 30 is a substantially flat plate having longer side portions and can cover the entire formation range of the terminal accommodating chambers 12A, 12B on a rear surface 10B of the housing 10. Wire insertion holes 31 are formed in the one-piece rubber plug 30 at positions corresponding to the respective terminal accommodating chambers 12A, 12B.

Figure 1:
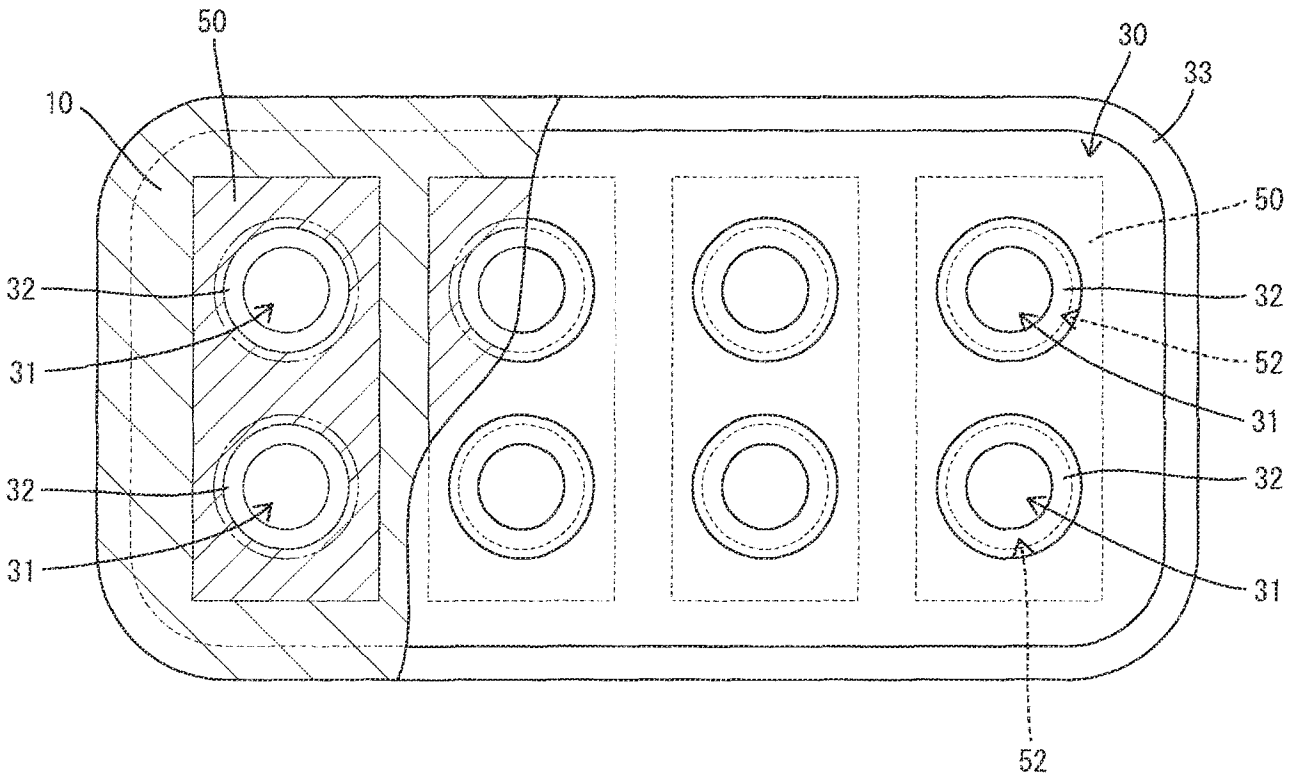
FIG. 1 is a front view of a ferrite core integrated waterproof connector according to a first embodiment.
Figure 2:
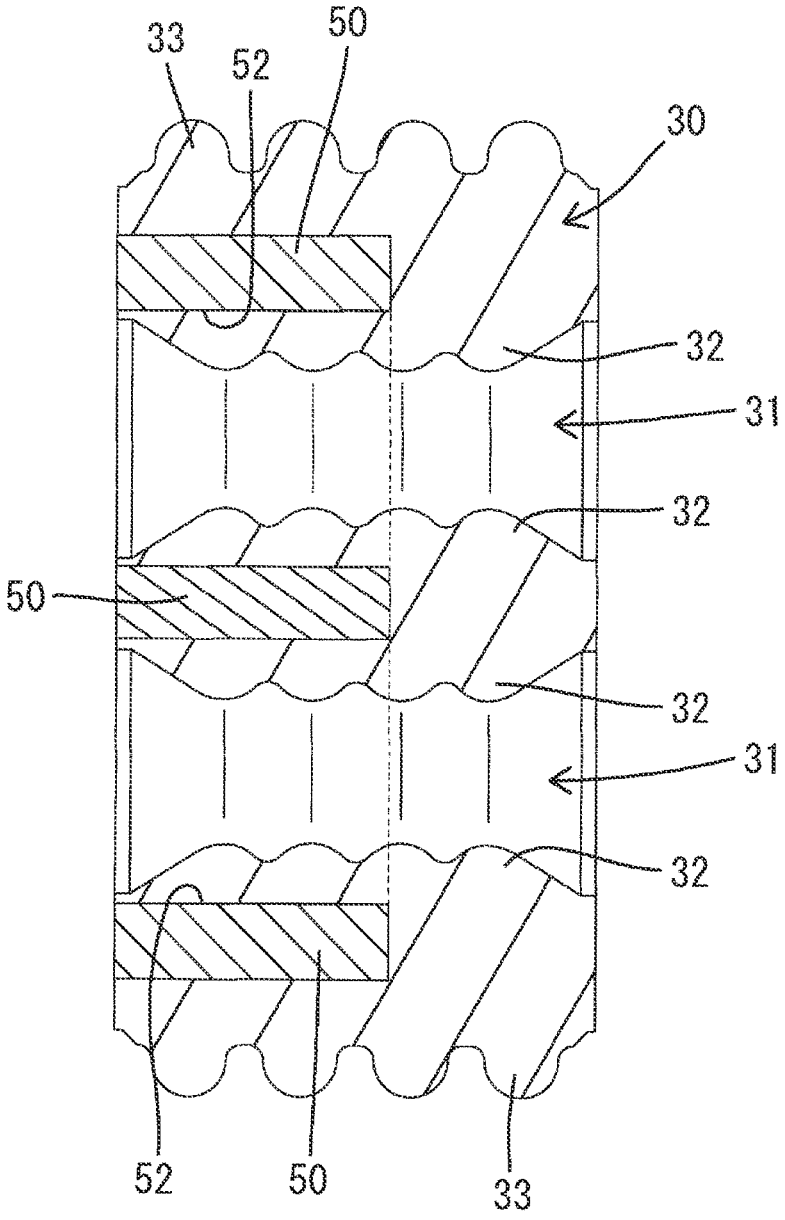
FIG. 2 is a side view in section of a one-piece rubber plug according to the first embodiment.

As shown in FIG. 1, substantially block-shaped ferrite cores 50 are embedded in the one-piece rubber plug 30. Each ferrite core 50 has longer sides and two) hollow portions 52 are formed along a longitudinal direction. As shown in FIGS. 1 and 2, the ferrite cores 50 are embedded and arranged in the one-piece rubber plug 30 so that the hollow portions 52 thereof coaxially communicate with the wire insertion holes 31 corresponding to the upper-row terminal accommodating chambers 12A and the wire insertion holes 31 corresponding to the lower-row terminal accommodating chambers 12B. Further, the ferrite cores 50 are arranged at positions near a left end part in a plate thickness direction of the one-piece rubber plug 30, as shown FIG. 2.

Each wire insertion hole 31 and each hollow portion 52 have a perfectly circular cross-sectional shape and a diameter of the hollow portion 52 is slightly larger than a diameter of the wire insertion hole 31. Further, as shown in FIG. 2, circumferentially extending inner lips 32 project at predetermined intervals along a penetrating direction on the inner peripheral surface of the wire insertion hole 31, and the ferrite core 50 is arranged inside the lips 32. Further, circumferentially extending outer lips 33 project on the outer peripheral surface of the one-piece rubber plug 30 for closely contacting the inner peripheral surface of a receptacle of an unillustrated mating housing in a liquid-tight manner. The holder 40 is made of synthetic resin and is a substantially flat plate having longer side portions similarly to the one-piece rubber plug 30. Positioning holes 41 penetrate through the holder 40 at positions corresponding to the respective wire insertion holes 31. Each positioning hole 41 has a perfectly circular cross-sectional shape with a diameter that is slightly larger than a diameter of the wire insertion hole 31. Further, the terminal fitting 20 is loosely insertable into the positioning hole 41. Further, unillustrated frame-shaped lock arms are formed to extend along a plate thickness direction from opposite left and right end edges of the holder 40 in a width direction. The holder 40 can be mounted behind and adjacent to the one-piece rubber plug 30 by resiliently locking the lock arms to unillustrated lock protrusions on the outer peripheral surface of the housing 10. In a mounted state, the one-piece rubber plug 30 is sandwiched between the rear end surface 10B of the housing 10 and the front surface of the holder 40 so that the mounted state is maintained.

The terminal fitting 20 is inserted into each terminal accommodating chamber 12A, 12B from behind the housing 10. The terminal fitting 20 is a male terminal fitting that is long and narrow in the front-back direction FBD as a whole and includes a tab Tb on a front end part. The wire WH has a substantially circular cross-section and is connected to a rear end part of the terminal fitting 20 and drawn out backward. Further, a diameter of the wire WH and a diameter of the wire insertion hole 31 are substantially equal. Thus, when the terminal fitting 20 is inserted into each terminal accommodating chamber 12A, 12B, the inner lips 32 provided on the inner peripheral surface of the wire insertion hole 31 of the one-piece rubber plug 30 are held in close contact with a coating of the wire WH in a sealed state.

According to this embodiment, the one-piece rubber plug 30 is mounted to cover at least part of the rear end surface 10B of the housing 10 and the ferrite cores 50 are embedded in the one-piece rubber plug 30. Noise superimposed on the wires WH can be effectively removed by the ferrite cores 50 embedded in the one-piece rubber plug 30. Further, since the ferrite cores 50 are provided at inner sides of base parts of the lips 32 of the one-piece rubber plug 30, the deformation of the lips 32 is unlikely to be hindered by the ferrite cores 50 when the lips 32 are deformed into close contact with the coatings of the wires WH. Therefore, good sealing for the wires WH can be ensured.

Further, the ferrite cores 50 are arranged at positions near the end part of the one-piece rubber plug 30 in the plate thickness direction. Thus, the ferrite cores 50 are not present on a side opposite to the side where the ferrite cores 50 are located when the lips 32 are deformed. Therefore, compressive deformation of the lips 32 is not hindered. Hence, sealing for the coatings of the wires WH can be improved further.

Figure 4:
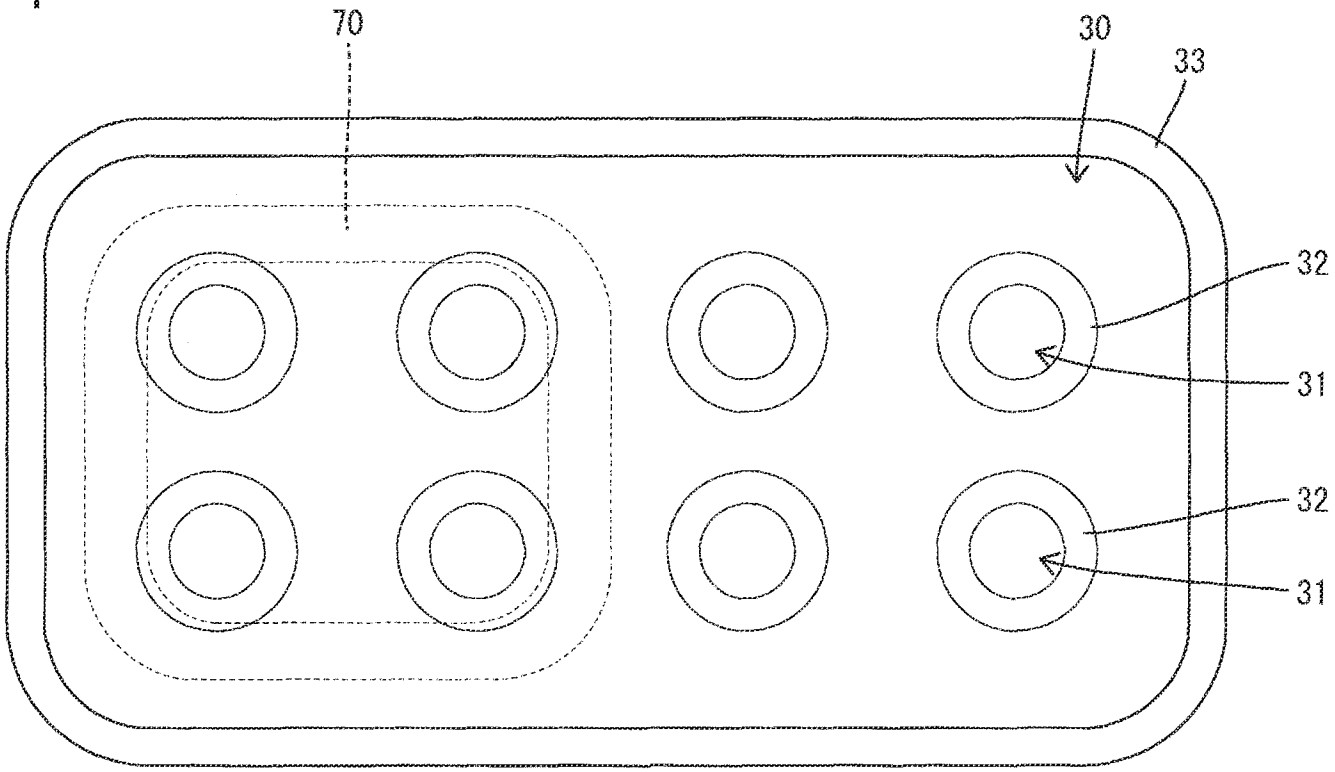
FIG. 4 is a front view of a ferrite core integrated waterproof connector according to a second embodiment.

FIG. 4 shows a second embodiment of the invention. The second embodiment differs from the first embodiment only in the shape of a ferrite core 70 embedded in a one-piece rubber plug 30. The other configuration is similar to or basically the same. Thus, common or similar components are denoted by the same reference signs and repeated description is omitted. The ferrite core 70 of the second embodiment has a rectangular ring shape to surround four wire insertion holes 31 as shown in FIG. 4. Noise is removed only for wires WH inserted in the wire insertion holes 31 surrounded by the ferrite core 70. If such a configuration is adopted, it is possible to provide terminal accommodating chambers 12A, 12B requiring an anti-noise measure and terminal accommodating chambers 12A, 12B requiring no anti-noise measure in the same connector housing 10.

The invention is not limited to the above described embodiments. For example, the following embodiments also are included in the scope of the invention.

The wire insertion holes have a perfectly circular cross-sectional shape in the above embodiments. However, there is no limitation to this and the wire insertion holes may have an elliptical or oval shape.

Ferrite cores having a block shape and a rectangular ring shape are used in the above embodiments. However, there is no limitation to this and the ferrite cores may have any structure as long as they have a closed or ring shape.

Male terminal fittings are used in the above embodiments. However, female terminal fittings may be used.

Four terminal accommodating chambers are formed in each of the upper and lower rows in the above embodiments. However, the number of the terminal accommodating chambers can vary.

The lips are formed on the inner peripheral surface of the wire insertion hole in the above embodiments. However, there is no limitation to this and the lips may not be formed.

The outer lips are formed on the one-piece rubber plug in the above embodiments. However, the outer lips may not be formed.

The ferrite cores are arranged near the end part of the one-piece rubber plug in the plate thickness direction in the above embodiments, they need not necessarily be arranged near the end part in the plate thickness direction and may be arranged in a central part in the plate thickness direction. By doing so, a restriction on the mounting direction of the one-piece rubber plug can be eliminated.

What is claimed is:

1. A ferrite core integrated fluidproof connector, comprising:

at least one wire having a terminal fitting connected thereto;

a housing formed with at least one terminal accommodating chamber capable of at least partly accommodating the terminal fitting;

a resilient plug mounted on the housing and formed with at least one wire insertion hole arranged to correspond to the terminal accommodating chamber, the wire insertion hole having an inner peripheral surface and at least one compressively deformable lip extending circumferentially on the inner peripheral surface of the wire insertion hole and projecting in from a base part that defines an area of the wire insertion hole having a maximum inner diameter, the lip being configured to closely contact an outer peripheral surface of the wire inserted through the wire insertion hole; and a ferrite core embedded in the resilient plug and being radially outward of the base parts of the at least one lips in a direction opposite to a projecting direction of the at least one lip in the resilient plug.

2. The connector of claim 1, wherein the resilient plug is plate-like one-piece rubber plug mounted on the housing to at least partly cover a rear end surface of the housing.

3. The connector of claim 1, wherein the at least one terminal accommodating chamber comprises a plurality of terminal accommodating chambers and wherein the at least one terminal fitting comprises a plurality of terminal fittings inserted respectively into the terminal accommodating chambers.

4. The connector of claim 3, wherein the at least one wire insertion hole comprises plural wire insertion holes formed at positions in the resilient plug corresponding respectively to the terminal accommodating chambers.

5. The connector of claim 1, wherein the ferrite core includes at least one hollow portion substantially concentric with at least one of the wire insertion holes.

6. The connector of claim 1, wherein the at least one lip comprises a plurality of lips along an axial direction of the wire insertion hole.

7. The connector of claim 1, wherein the ferrite core is arranged at a position near an end part of the resilient plug in an axial direction of the wire.

8. A ferrite core integrated fluidproof seal, comprising:

a plate-shaped resilient plug having opposite first and second surfaces and at least one wire insertion hole extending through the plug from the first surface to the second surface, each of the wire insertion holes having an inner peripheral surface, a plurality of compressively deformable circumferentially extending lips projecting radially inwardly into the respective wire insertion hole from the inner peripheral surface; and at least one ferrite core embedded in the resilient plug at a position closer to the first surface than the second surface, the ferrite core having hollow portions substantially concentric with at least one of the wire insertion holes and being radially outward of base parts of the lips in a direction opposite to a projecting direction of the one or more lips in the resilient plug.

* * * * *